US006653927B2

(12) United States Patent
Fukumoto et al.

(10) Patent No.: US 6,653,927 B2
(45) **Date of Patent: *Nov. 25, 2003**

(54) STRUCTURE USED FOR MANUFACTURING A LINE-TYPE HEATER

(75) Inventors: Hiroshi Fukumoto, Kyoto (JP); Tokihiko Kishimoto, Kyoto (JP)

(73) Assignee: Rohm Co., Ltd., Kyoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/326,695

(22) Filed: Jun. 7, 1999

(65) Prior Publication Data

US 2002/0069513 A1 Jun. 13, 2002

(30) Foreign Application Priority Data

Jun. 9, 1998 (JP) ..... 10-160802

(51) Int. Cl.[7] ..... H01C 7/100

(52) U.S. Cl. ..... 338/203; 338/320; 338/195

(58) Field of Search ..... 29/610.1, 611, 29/612, 619, 830, 832, 835, 851, 861, 541; 216/56, 65, 76, 77; 428/209, 901; 338/195, 320, 203

(56) References Cited

U.S. PATENT DOCUMENTS

| | | | | | |
|---|---|---|---|---|---|
| 4,426,773 | A | * | 1/1984 | Hargis | 29/832 |
| 4,961,065 | A | | 10/1990 | Taylor | |
| 5,592,276 | A | | 1/1997 | Ohtsuka et al. | |
| 5,834,084 | A | * | 11/1998 | Maggio | 428/64.1 |
| 5,871,828 | A | * | 2/1999 | Volkert | 428/40.1 |
| 5,928,526 | A | * | 7/1999 | Morley | 216/65 |
| 6,093,578 | A | * | 7/2000 | Klappert et al. | 438/30 |
| 6,195,881 | B1 | * | 3/2001 | Giardina et al. | 29/846 |

* cited by examiner

*Primary Examiner*—Karl D. Easthom
(74) *Attorney, Agent, or Firm*—Morgan, Lewis & Bockius LLP

(57) ABSTRACT

The scribe line is constituted by a large number of depressed portions of desired depth formed by radiation of a laser beam in a surface of the raw substrate corresponding to a boundary line between adjacent insulating substrates so that the depressed portions are arranged in a line at fixed pitch intervals along the boundary line, and a portion where the pitch intervals of the depressed portions are reduced is provided over a desired length on the way of the scribe line, or a portion where the depth of the depressed portions is increased is provided over a desired length on the way of each of the scribe lines.

12 Claims, 8 Drawing Sheets

STRUCTURE USED FOR MANUFACTURING A LINE-TYPE HEATER

BACKGROUND THE INVENTION

1. Field of the Invention

The present invention relates to a structure of a raw substrate used for manufacturing insulating substrates of a line-type heater used as a heating source or the like in a toner fixing portion of a copying machine or an electrophotographic printer.

2. Description of the Prior Art

Generally, such a line-type heater is well known conventionally, and it is configured such that, for example, as disclosed in JP-A-7-147180, a heating resistance film is formed on the surface of an insulating substrate of ceramic material which is configured, in the form of a long strip so as to extend in a line in the longitudinal direction of the insulating substrate to generate heat from all over its length when a current is supplied to the heating resistance film from the opposite sides thereof.

Conventionally, in manufacturing the line-type heater, such a method has been adopted which comprises the steps of preparing a raw substrate of ceramic material constituted by a plurality of sheets of long strip-like insulating substrates which are put side by side and integrated with each other, forming heating resistance films on places of the surface of the raw substrate correspondingly to the respective insulating substrates, and breaking (dividing) this raw substrate into individual insulating substrate.

When the raw substrate is broken into individual insulating substrates, such a method is adopted which comprises the step of forming a large number of depressed portions (recess portions) of desired depth by radiation of a laser beam in the surface of the raw substrate correspondingly to boundary lines between the individual insulating substrates before or after formation of the heating resistance film so that the depressed portions are arranged in lines at fixed pitch intervals along the boundary lines. Thus, the lines in which the large number of depressed portions are provided are used as scribe lines for breaking the raw substrate into the individual insulating substrates.

However, since the strength of each insulating substrate broken out from the raw substrate in such a manner is uniform at every place all over the length of the insulating substrate, it cannot be expected to generate a crack in the insulating substrate when the temperature of the heating resistance film formed in this insulating substrate becomes an abnormally high value. Therefore, there is a fear that a more abnormally high temperature is brought about.

Therefore, conventionally, at least one small-diameter through hole is formed in a portion on the longitudinal way of the insulating substrate, so that the insulating substrate can crack in the portion of the through hole in case of abnormal temperature to thereby prevent the temperature from increasing more.

In the case where configuration is made such that at least one small-diameter through hole is formed in a portion on the longitudinal way of an insulating substrate, the insulating substrate can crack in the portion of the through hole at the time of abnormal temperature. However the strength of the insulating substrate is reduced extremely in the portion provided with the through hole because the insulating substrate is shaped into a long strip. Accordingly, there has been a problem that the respective insulating substrates are often snapped in their through hole portions when the raw substrate is broken (divided) into individual insulating substrate, or when the respective insulating substrates broken out from the raw substrate are handled ordinarily, for example, carried, attached and so on.

SUMMARY OF THE INVENTION

It is an object of the present invention to provide a structure of a raw substrate used for manufacturing line-type heaters which are easy to crack only at abnormally high temperature while keeping usually their strength.

Namely, it is a first technical object of the present invention to provide a structure of a raw substrate by which insulating substrates for use in line-type heaters can be manufactured in such a mode that the insulating substrates are not snapped easily when they are broken out from the raw substrate and when the individual insulating substrates are handled, for example, carried, attached and so on, but any one of the insulating substrate can crack surely only when the temperature of a heating resistance film formed thereon reaches an abnormally high value.

In order to achieve the foregoing technical problems, a first aspect of the raw substrate is a raw substrate for use for manufacturing insulating substrates in a line-type heater, which comprises a large number of depressed portions formed by radiation of a laser beam in a surface of said raw substrate correspondingly to boundary lines by which the raw substrate is divided into a plurality of strip-like insulating substrates integrated with each other in parallel, so that said depressed portions are arranged in lines at fixed pitch intervals along said boundary lines, and said lines are formed as scribe lines for breaking said raw substrate into said insulating substrates; wherein the scribe lines have a portion where total volume of the depressed portion per unit length is increased.

A second aspect of the raw substrate is a raw substrate for use for manufacturing insulating substrates in a line-type heater according to the first aspect, wherein each of said scribe lines has an area where pitch intervals of said depressed portions are reduced.

A third aspect of the raw substrate is a raw substrate for use for manufacturing insulating substrates in a line-type heater according to the first aspect, wherein each of said scribe lines has a portion where the depth of said depressed portions is increased.

Namely according to the present invention, provided is a structure of a raw substrate for use for manufacturing insulating substrates in a line-type heater, in which the raw substrate is constituted by a plurality of long strip-like insulating substrates put side by side and integrated with each other, a large number of depressed portions of desired depth are formed by radiation of a laser beam in a surface of the raw substrate correspondingly to boundary lines between the insulating substrates so that the depressed portions are arranged in lines at fixed pitch intervals along the boundary lines, and the lines in which the large number of depressed portions are arranged are formed as scribe lines for breaking the raw substrate into the insulating substrates; characterized in that a portion where the pitch intervals of the depressed portions are reduced is provided over a desired length on the way of each of the scribe lines, or a portion where the depth of the depressed portions is increased is provided over a desired length on the way of each of the scribe lines.

A fourth aspect of the raw substrate is a raw substrate for use for manufacturing insulating substrates in a line-type heater of the present invention, which comprises a large number of depressed portions formed by radiation of a laser beam in a surface of said raw substrate correspondingly to boundary lines by which the raw substrate is divided into a plurality of strip-like insulating substrates integrated with each other in parallel, so that said depressed portions are arranged in lines at fixed pitch intervals along said boundary lines, and said lines are formed as scribe lines for breaking said raw substrate into said insulating substrates; wherein said raw substrate comprises additional depressed portions formed by using the same laser beam in each of the insulating substrates.

A fifth aspect of the raw substrate is a raw substrate for use for manufacturing insulating substrates in a line-type heater according to the fourth aspect, wherein the additional depressed portions are arranged in perpendicular to the scribe lines.

A sixth aspect of the raw substrate is a raw substrate for use for manufacturing insulating substrates in a line-type heater according to the fourth aspect, wherein the additional depressed portions are arranged in parallel to the scribe lines.

A seventh aspect of the method is a method of manufacturing a line-type heater, which comprises the steps of: forming scribe lines of a large number of depressed portions on a surface of a raw substrate, by radiating a laser beam correspondingly to boundary lines by which the raw substrate is divided into a plurality of strip-like insulating substrates integrated with each other in parallel, so that said depressed portions are arranged in lines at fixed pitch intervals along said boundary lines regularly; forming a heating resistance on a surface of each of the strip-like insulating substrates; and dividing the raw substrate into a plurality of strip-like insulating substrates along the scribe lines before or after the step of forming a heating resistance, wherein the step of forming scribe lines comprises a step of irradiating a laser beam so that the scribe lines have a portion where total volume of the depressed portion per unit length is increased.

An eight aspect of the method is a method of manufacturing a line-type heater, according to the seventh aspect, wherein the step of forming scribe lines comprises a step of changing an irradiation pitch of the laser beam so that the each of said scribe lines has an area where pitch intervals of said depressed portions are reduced.

A ninth aspect of the method is a method of manufacturing a line-type heater, according to the seventh aspect, wherein the step of forming scribe lines comprises-a step of changing an irradiation energy of the laser-beam so that the each of said scribe lines has a portion where the depth of said depressed portions is increased.

A tenth aspect of the method is a method of manufacturing a line-type heater, according to the seventh aspect, wherein the step of forming scribe lines comprises a step of forming an additional depressed portion in an area corresponding to each of the insulating substrates.

An eleventh aspect of the method is a method of manufacturing a line-type heater, according to the tenth aspect, wherein the additional depressed portions are arranged in perpendicular to the scribe lines.

A twelfth aspect of the method is a method of manufacturing a line-type heater, according to the tenth aspect, wherein the additional depressed portions are arranged in parallel to the scribe lines.

According to the present invention, a portion where the pitch intervals of the depressed portions are reduced is provided over a desired length on the way of each of the scribe lines, or a portion where the depth of the depressed portions is increased is provided over a desired length on the way of each of the scribe lines. As a result, of the longitudinal side surface of each of the broken insulating substrates, in the portion where the pitch intervals of the depressed portions are reduced, or in the portion where the depth of the depressed portions is increased, the depressed portions are arranged in the state where their pitch intervals are reduced or in the state where their depth is increased, so that the strength in this portion is made lower than the strength in the other portion. Accordingly, when the temperature of the heating resistance film formed on the insulating substrate reaches an abnormal value, the insulating substrate can crack surely in the above-mentioned portion. In addition, since the reduction of the strength is much smaller than that in the conventional case where through holes are formed in the insulating substrate, there is no case that the insulating substrate is snapped easily in the above-mentioned portion when the insulating substrate is broken out from the raw substrate or when the insulating substrate is handled, for example, carried, attached and so on.

Moreover, as stated in the above aspect, a plurality of depressed portions of desired depth are provided by radiation of a laser beam in a portion on the way in a longitudinal direction of each of the insulating substrates and in part in width direction of the insulating substrate, so that the widthwise depressed portions are arranged at desired pitch intervals in a direction perpendicular to the scribe lines. As a result, the strength in the portion which is a part in the longitudinal direction of the insulating substrate and in which a plurality of depressed portions are arranged at desired pitch intervals in the direction perpendicular to the scribe line is made lower than the strength in the other portion in the longitudinal direction of the insulating substrates, that is, the portion where no such a plurality of depressed portions are arranged in the direction perpendicular to the scribe line. Accordingly, when the temperature of the heating resistance film formed on the insulating substrate reaches an abnormal value, the insulating substrate can crack surely in the above-mentioned portion where a plurality of depressed portions are arranged in the direction perpendicular to the scribe line. In addition, since the reduction of the strength is much smaller than that in the conventional case where through holes are formed in the insulating substrate, there is no case that the insulating substrate is snapped easily in the above-mentioned portions when the insulating substrate is broken out from the raw substrate or when the insulating substrate is handled, for example, carried, attached and so on.

Further, as stated in the above aspect, a plurality of depressed portions of desired depth are provided by the radiation of a laser beam in a portion over a part of length on the way of the whole length of each of the insulating substrates and in adjacent to the scribe line so that the plurality of depressed portions are arranged at desired pitch intervals in a direction parallel with the scribe lines. As a result, the strength in the portion of the insulating substrate where a plurality of depressed portions are arranged at desired pitch intervals in the direction parallel with the scribe line is made lower than the strength in the other portion in the longitudinal direction of the insulating substrate, that is, the portion where no such a plurality of depressed portions are arranged in the direction parallel with the scribe line. Accordingly, when the temperature of the heating resistance film formed on the insulating substrate reaches an abnormal value, the insulating substrate can crack surely in the above-mentioned portion where a plurality of depressed portions are arranged in the direction parallel with the scribe line. In addition, since the reduction of the strength is much smaller than that in the conventional case where a through hole is formed in the insulating substrate, there is no case that the insulating substrate is snapped easily in the above-mentioned portion when the insulating substrate is broken out from the raw substrate or when the insulating substrate is handled, for example, carried, attached and so on.

DESCRIPTION OF THE PREFERRED EMBODIMENTS

An embodiment of the present invention will be described with reference to the drawings.

Embodiment 1

Figure 1:
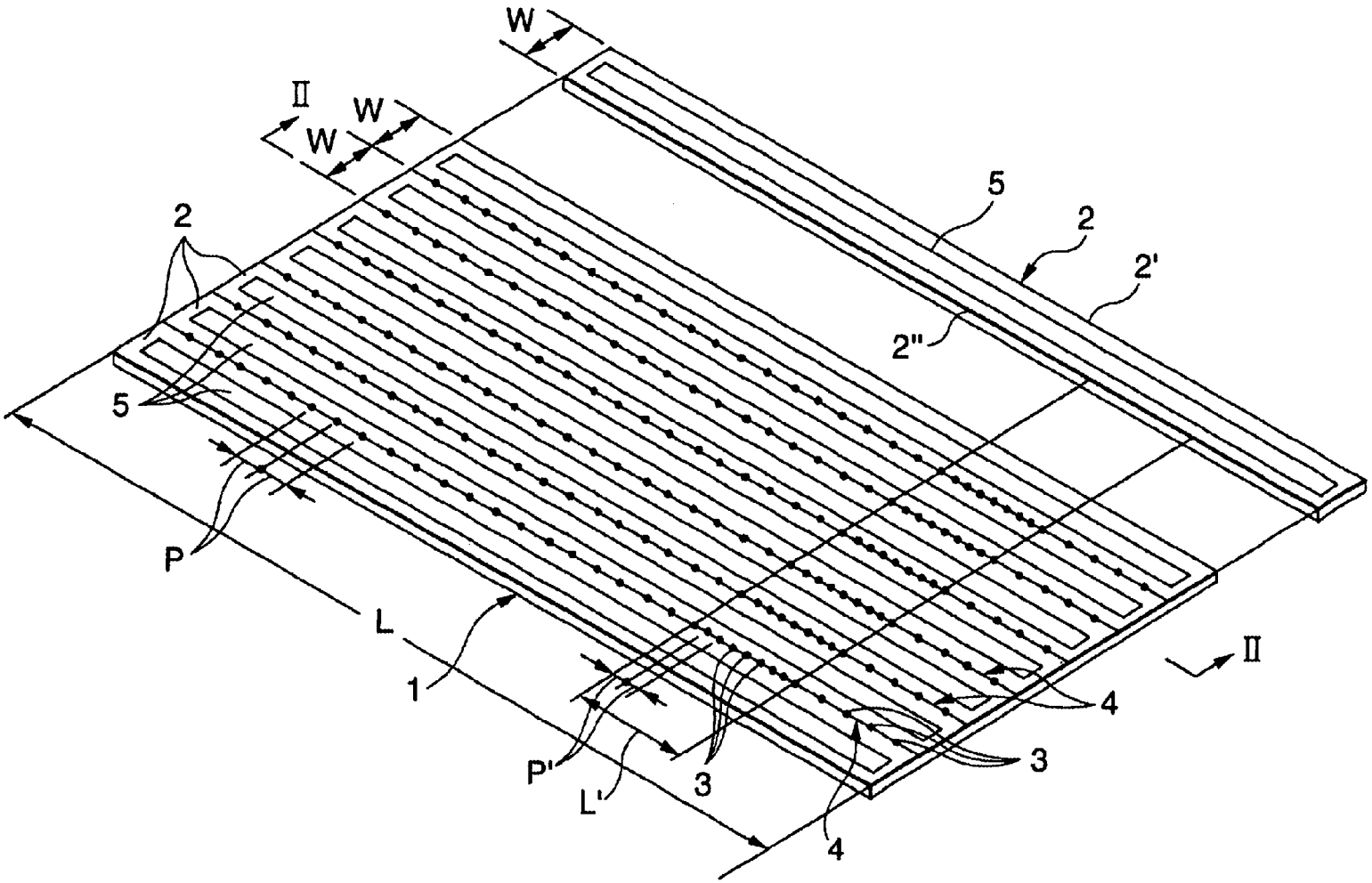
FIG. 1 represents a perspective view showing a first embodiment of the present invention.
Figure 2:
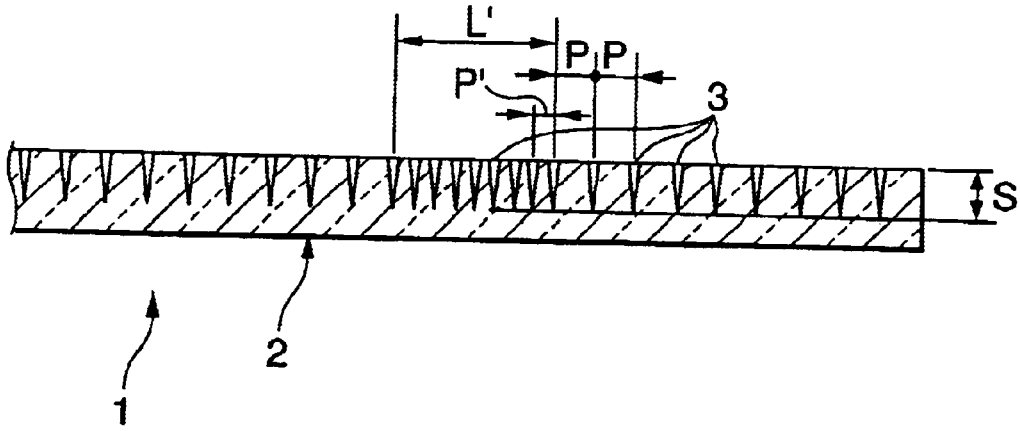
FIG. 2 represents an enlarged sectional view taken on line II—II in FIG. 1.

FIG. 1 and FIG. 2 show a first embodiment.

In these drawings, the reference numeral 1 represents a raw substrate of ceramic material constituted by a plurality of insulating substrates 2 formed into long strips each having a short width of W and a long length of L, arranged side by side and integrated with each other. A large number of depressed portions 3 of a desired depth of S based are formed by radiation of a laser beam in the portions in the surface of this raw substrate 1 and on the boundary lines between the insulating substrates 2, so that the depressed portions 3 are arranged in lines at a fixed pitch interval P along the above-mentioned boundary lines. In such a manner, scribe lines 4 for breaking the raw substrate 1 into the insulating substrates 2 are formed by the lines in which these large number of depressed portions 3 are arranged.

When the scribe lines 4 are formed in the raw substrate 1, a portion where the pitch interval of the depressed portions 3 is reduced from P to P' is provided on the way of each scribe line 4 over a desired length of L' which is a part of the whole length L of each insulating substrate 2.

To reduce the pitch interval of the depressed portions 3 formed by radiation of a laser beam from P to P' over the desired length L' which is a part of the whole length L of each insulating substrate 2, it will go well if the raw substrate 1 and the laser beam are moved relatively and intermittently at the fixed interval P, while the pitch interval of the relative movement is reduced from P to P' only in the above-mentioned portion over the length L' on the way of forming the depressed portions 3 by radiation of the laser beam when the relative movement between the raw substrate 1 and the laser beam is stopped.

Then, after the scribe lines 4 are formed in the raw substrate 1, a heating resistance film 5 is formed on each of the insulating substrate 2, and, next, this raw substrate 1 is broken into the insulating substrates 2 one by one. Alternatively, after the heating resistance film 5 is formed on each of the insulating substrate 2 in the raw substrate 1, the scribe lines 4 are formed, and, next, this raw substrate 1 is broken into the insulating substrates 2 one by one.

If the raw substrate 1 is broken into the insulating substrates 2 one by one along the scribe lines 4 in such a manner, the depressed portions 3 are arranged so that their pitch interval is reduced to P' in the portion of the desired length L' in at least one of longitudinal left and right side surfaces 2' and 2" of each of these insulating substrates 2. As a result, the strength in this portion where the pitch interval of the respective depressed portions 3 is reduced to P' is made lower than the strength in the other portion, that is, in the portion where the pitch interval of the depressed portions 3 is not reduced. Accordingly, the insulating substrate 2 can crack surely in the portion where the pitch interval of the respective depressed portions 3 is reduced to P', when the temperature of the heating resistance film 5 formed on the insulating substrate reaches an abnormally high value. In addition, since the reduction of the strength is much smaller than that in the conventional case where a through hole is formed in the insulating substrate, there is no case that the insulating substrate 2 is snapped easily in the portion where the pitch interval of the respective depressed portions 3 is reduced to P' when the raw substrate 1 is broken into the insulating substrates or when the insulating substrate is handled, for example, carried, attached and so on.

Embodiment 2

Figure 3:
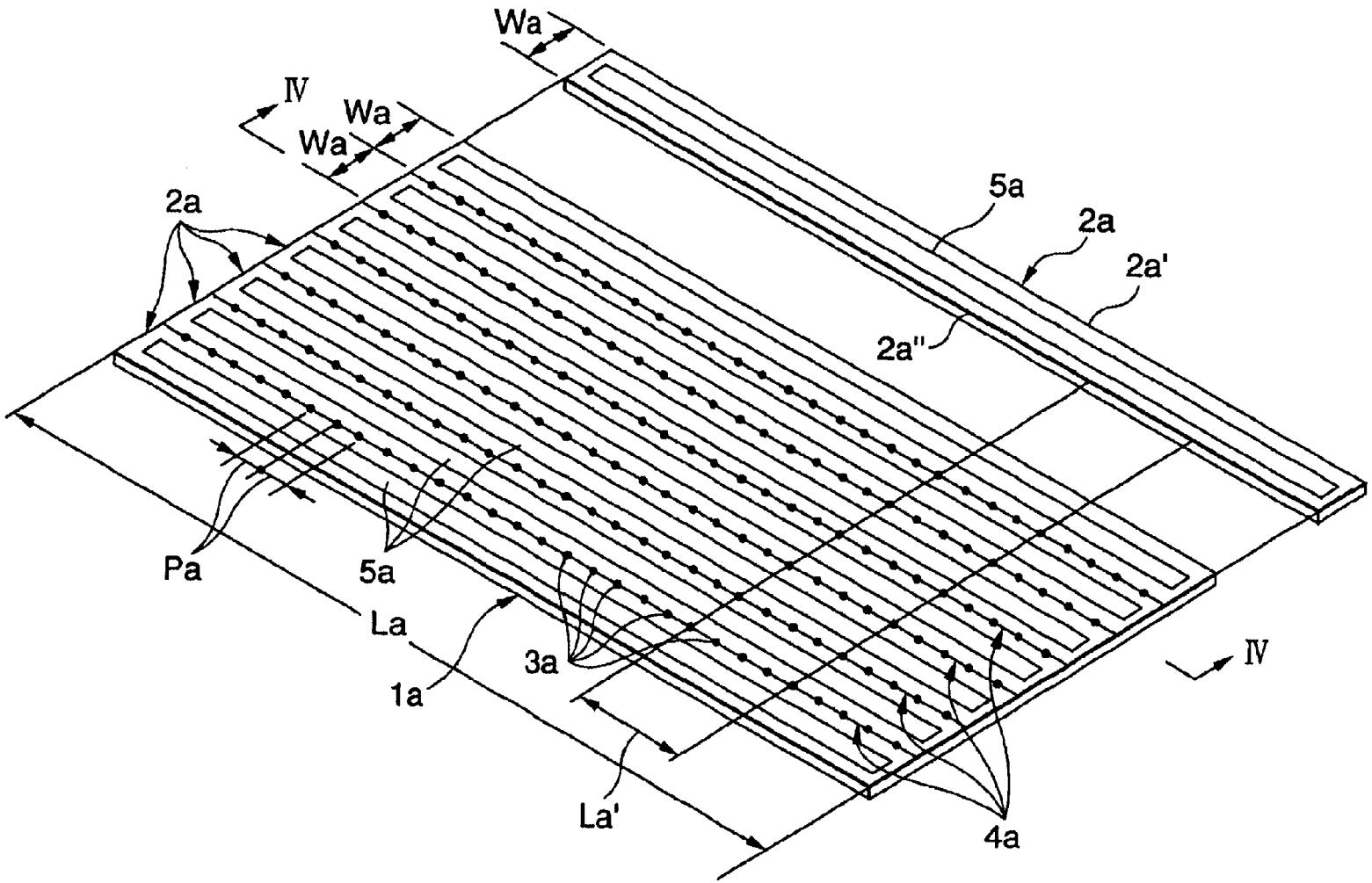
FIG. 3 represents a perspective view showing a second embodiment of the present invention.
Figure 4:
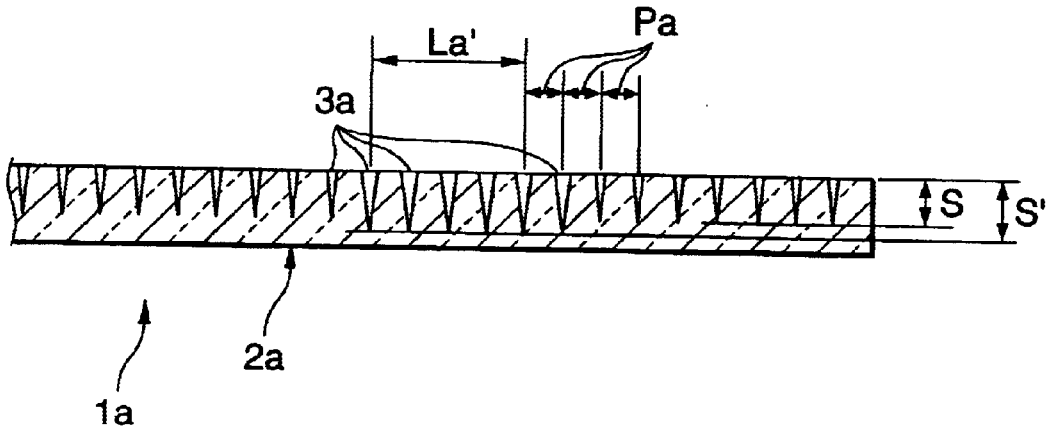
FIG. 4 represents an enlarged sectional view taken on line IV—IV in FIG. 3.

Next, FIGS. 3 and 4 show a second embodiment.

In these drawings, the reference numeral 1*a* represents a raw substrate of ceramic material constituted by a plurality of insulating substrates 2*a* formed into long strips each having a short width of Wa and a long length of La, arranged side by side and integrated with each other in the same manner as the above-mentioned first embodiment. A large number of depressed portions 3*a* of a desired depth of S based are formed by radiation of a laser beam in the portions in the surface of this raw substrate 1*a* and on the boundary lines between the insulating substrates 2*a*, so that the depressed portions 3*a* are arranged in lines at a fixed pitch interval Pa along the above-mentioned boundary lines. In such a manner, scribe lines 4*a* for breaking the raw substrate 1*a* into the insulating substrates 2*a* are formed by the lines in which these large number of depressed portions 3*a* are arranged. On the way of each of these scribe lines, a portion where the depth of the respective depressed portions 3 is increased from S to S' is provided in a portion of a desired length of La' which is a part of the whole length of each of the insulating substrates 2*a*.

In the depressed portions 3 which are made by radiation of a laser beam, in order to increase the depth from S to S', it will go well if the output of the laser beam is increased, or if the radiation time of the laser beam is prolonged.

Then, after the scribe lines 4*a* are formed in the raw substrate 1*a*, a heating resistance film 5*a* is formed on each of the insulating substrate 2*a*, and, next, this raw substrate 1*a* is broken into the insulating substrates 2*a* one by one. Alternatively, after the heating resistance film 5*a* is formed on each of the insulating substrate 2*a* in the raw substrate 1*a*, the scribe lines 4*a* are formed, and, next, this raw substrate 1*a* is broken into the insulating substrates 2*a* one by one.

If the raw substrate 1*a* is broken into the insulating substrates 2*a* one by one along the scribe lines 4*a* in such a manner as described above, the depressed portions 3*a* are arranged with the depth thereof increased to S' in the portion of the desired length La' in at least one 2*a*' of the longitudinal left and right side surfaces 2*a*' and 2*a*" of each of these insulating substrates 2*a*. As a result, the strength in this portion where the depth of the respective depressed portions 3*a* increases to S' becomes lower than the strength in the other portion, that is, in the portion where the depth of the depressed portions 3*a* is not increased. Accordingly, the insulating substrate 2*a* can crack surely in the portion where the depth of the respective depressed portions 3*a* is increased to S' when the temperature of the heating resistance film 5*a* formed on the insulating substrate reaches an abnormally high value. In addition, since the reduction of the strength is much smaller than that in the conventional case where a through hole is formed in the insulating substrate, there is no case that the insulating substrate 2*a* is snapped easily in the portion where the depth of the respective depressed portions 3*a* is increased to S' when the raw substrate 1*a* is broken into the insulating substrates or when the insulating substrate is handled, for example, carried, attached and so on.

Embodiment 3

Figure 5:
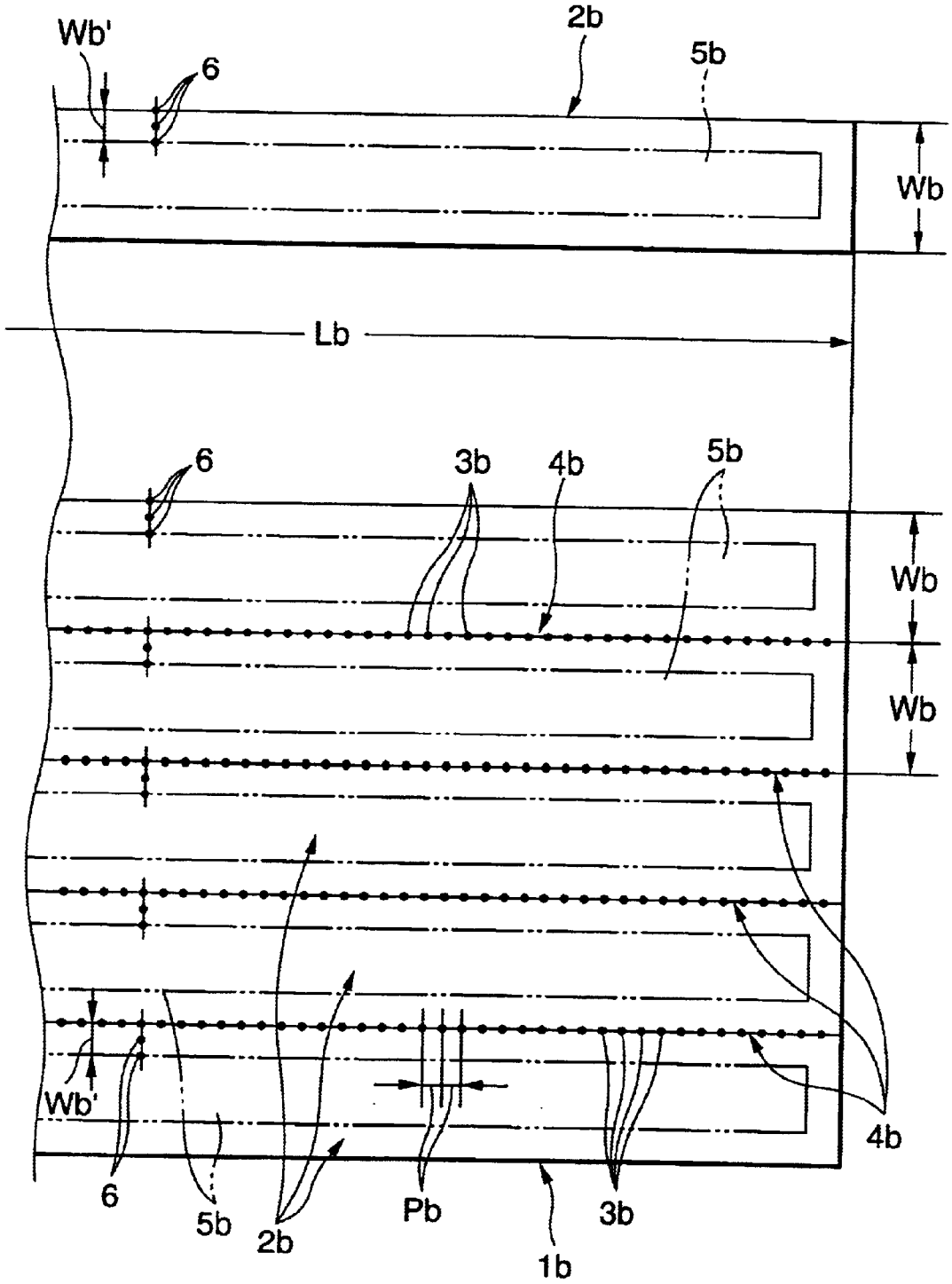
FIG. 5 represents a plan view showing a third embodiment of the present invention.
Figure 6:
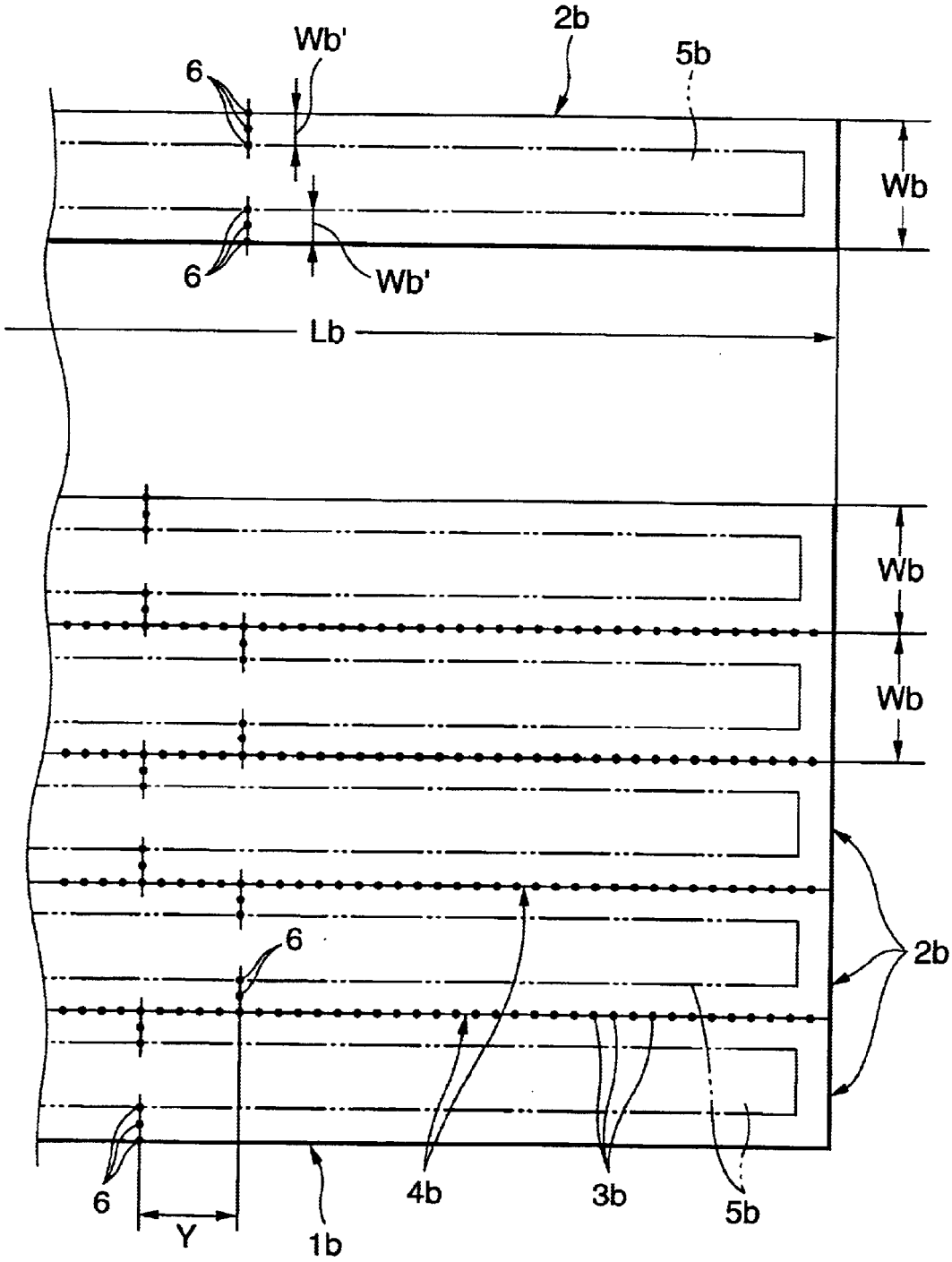
FIG. 6 represents a plan view showing a modification of the third embodiment of the present invention.
Figure 7:
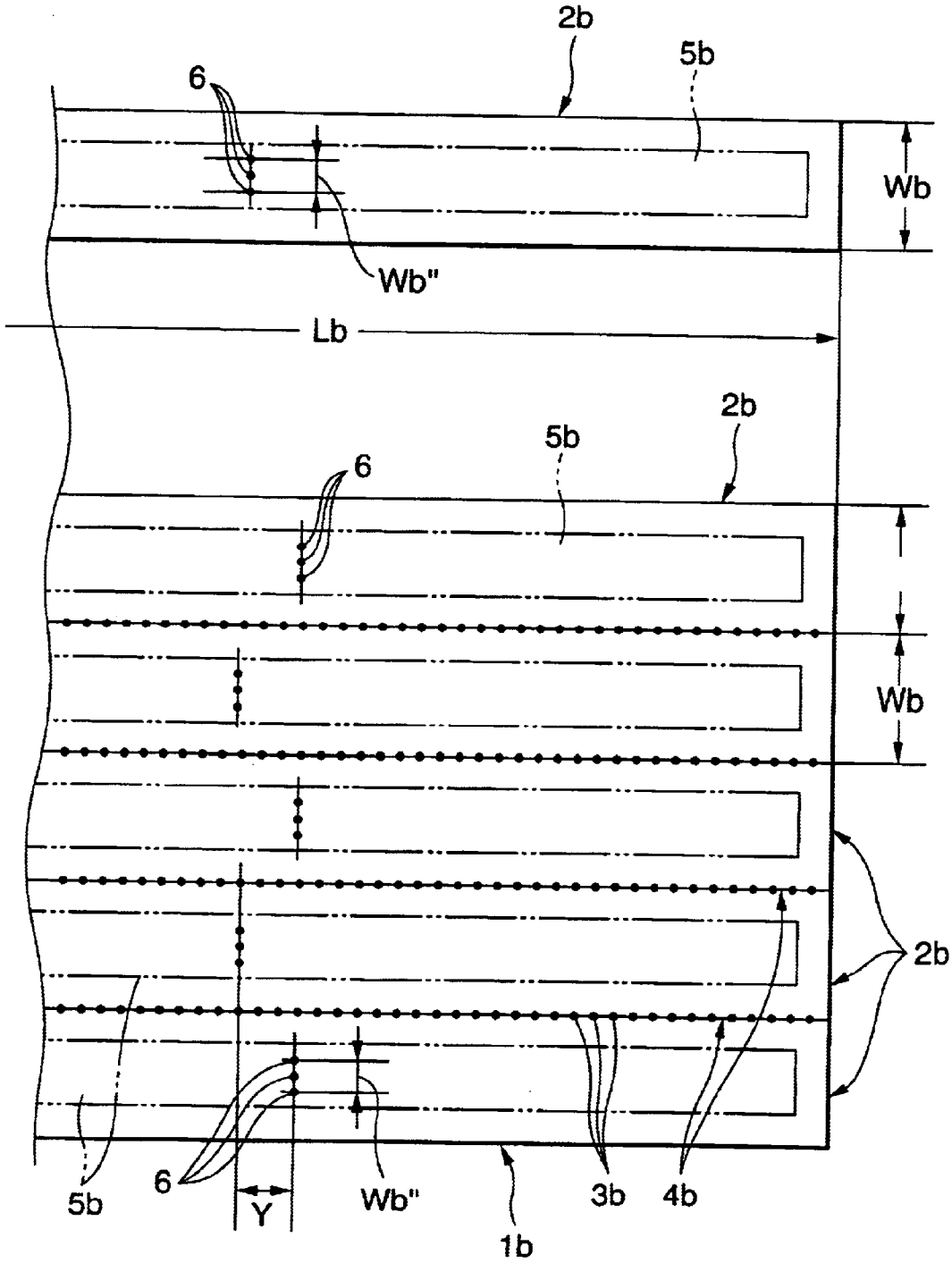
FIG. 7 represents a plan view showing another modification of the third embodiment of the present invention.

FIGS. 5 to 7 show a third embodiment.

In this third embodiment, a raw substrate 1*b* of ceramic material is constituted by a plurality of insulating substrates 2*b* which are formed in long strips each having a short width of Wb and a long length of Lb, and which are arranged side by side and integrated with each other. A large number of depressed portions 3*b* of a desired depth are formed by radiation of a laser beam in the portions in the surface of this raw substrate 1*b* and on the boundary lines between the insulating substrates 2*b*, so that the depressed portions 3*b* are arranged in lines at a fixed pitch interval Pb along the above-mentioned boundary lines. In such a manner, scribe lines 4*b* for breaking the raw substrate 1*b* into the insulating substrates 2*b* are formed by the lines in which these large number of depressed portions 3*b* are arranged. On the other hand, a plurality of depressed portions 6 of desired depth based are formed by radiation of a laser beam in portions on the way in the longitudinal direction of the insulating substrates 2*b* over a length of Wb' in the width direction of each of the insulating substrates 2*b*, so that the plurality of depressed portions 6 of desired depth due to radiation of a laser beam are arranged at a desired pitch interval Pb' in the direction perpendicular to the scribe lines 4*b* (this pitch interval Pb' is narrower than the pitch interval Pb in each of the depressed portions 3*b* constituting the scribe lines 4*b*).

To form a plurality of depressed portion 6 side by side in a portion in the width direction of each of the insulating substrates 2*b* by radiation of a laser beam, there is a case where these depressed portions 6 are formed in one of the both left and right end portions in the width direction of the insulating substrate 2*b* so that the depressed portions 6 are arranged only in a portion of the length Wb' in the width direction, as shown in FIG. 5. In another case, the plural depressed portions 6 are formed in both the left and right end portions in the width direction of the insulating substrate 2*b* so that the depressed portions 6 are arranged in a portion of the length Wb' in the width direction, as shown in FIG. 6. In a further case, the plural depressed portions 6 are formed in a middle portion in the width direction of each of the insulating substrates 2*b* so that the depressed portions 6 are arranged only in a portion of the length Wb" in the width direction, as shown in FIG. 7.

The depressed portions 6 in such portions in the width direction are formed simultaneously with and in the same process as that in the formation of the depressed portions 3*b* constituting the scribe lines 4*b*.

Thus, a plurality of depressed portions 6 of desired depth are formed by radiation of a laser beam in portions on the way in the longitudinal direction of the insulating substrates 2*b* and over a length of Wb' or Wb" in the width direction of each of the respective insulating substrates 2*b* at a desired pitch interval in the direction perpendicular to each of the scribe lines 4*b*. Accordingly, the strength in the portion in the longitudinal direction of each insulating substrate 2*b* where the plural depressed portions 6 are arranged at desired pitch intervals in the direction perpendicular to the scribe lines 4*b* is made lower than the strength in the other portion in the longitudinal direction of each insulating substrate 2*b* where a plurality of depressed portions 6 are not arranged in the direction perpendicular to each scribe line 4*b*. Accordingly, when the temperature of a heating resistance film 5*b* formed on each of these insulating substrates 2*b* reaches an abnormal value, the insulating substrate 2*b* can crack surely in the above-mentioned portion where the plural depressed portions 6 are arranged in the direction perpendicular to the scribe line 4*b*. In addition, since the reduction of the strength is much smaller than the conventional case where a through hole is formed in the insulating substrate, there is no case where the insulating substrate 2*b* is snapped easily in the portion where the plural depressed portions 6 are arranged in the direction perpendicular to the scribe line 4*b* when a raw substrate 1*b* is broken into insulating substrates or when the insulating substrates are handled, for example, carried, attached and so on.

In the case where the plural depressed portions 6 are formed in both the left and right end portions in the width direction of each insulating substrate 2*b* or only in a middle portion in the width direction, it is more preferable to shift the depressed portions 6 from one insulating substrate 2*b* to another insulating substrate 2*b* by a desired distance of Y as shown in FIG. 6 or FIG. 7 to thereby reduce the probability that any one of the insulating substrates 2*b* is snapped when the raw substrate 1*b* is broken into the insulating substrates 2*b* one by one.

Embodiment 4

Figure 8:
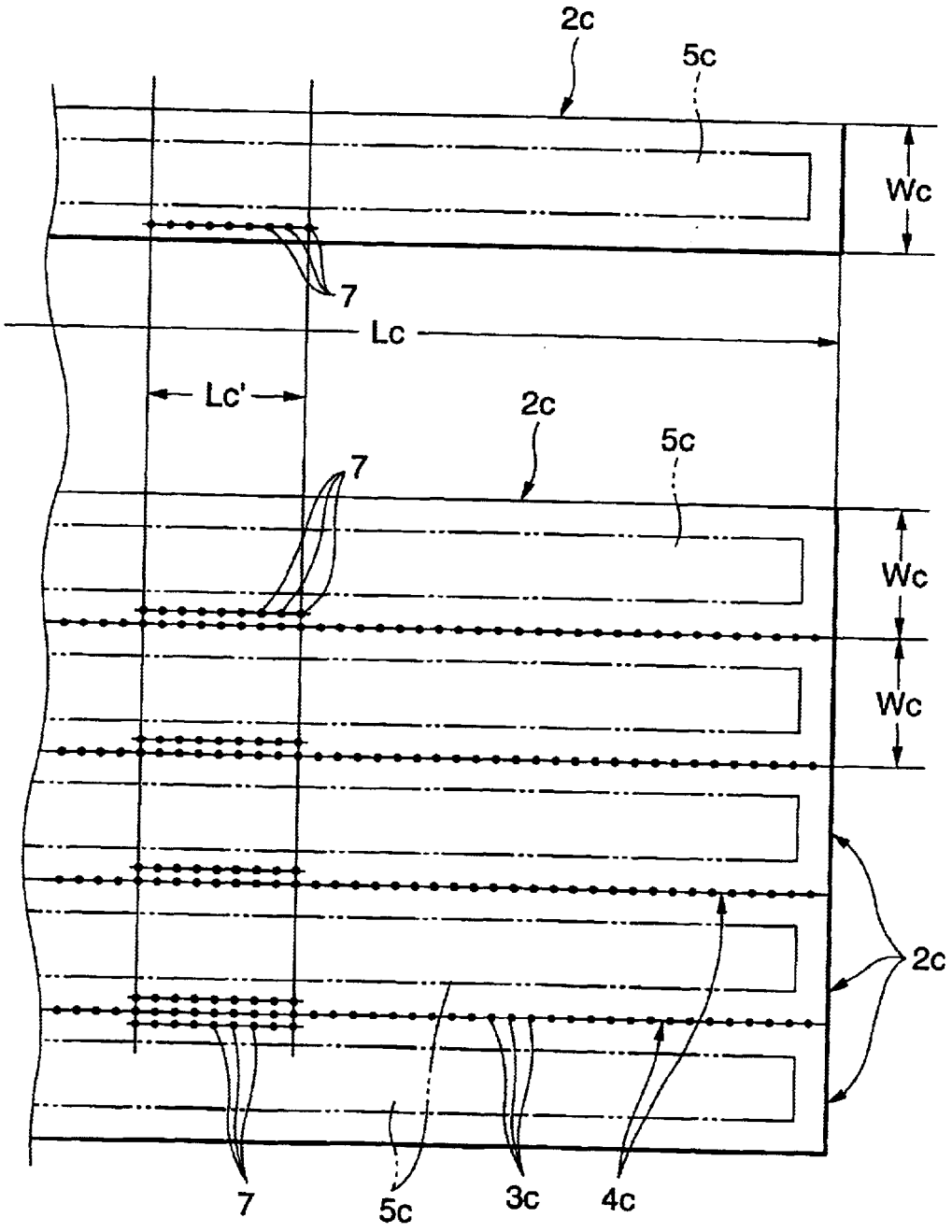
FIG. 8 represents a plan view showing a fourth embodiment of the present invention.

Furthermore, FIG. 8 shows a fourth embodiment.

In this fourth embodiment, a raw substrate 1*c* of ceramic material is constituted by a plurality of insulating substrates 2*c* which are formed in long strips each having a short width of Wc and a long length of Lc, and which are arranged side by side and integrated with each other. A large number of depressed portions 3*c* of a desired depth are formed by radiation of a laser beam in the portions in the surface of this raw substrate 1*c* and on the boundary lines between the insulating substrates 2*c*, so that the depressed portions 3*c* are arranged in lines at a fixed pitch interval Pc along the above-mentioned boundary lines. In such a manner, scribe lines 4*c* for breaking the raw substrate 1*c* into the insulating substrates 2*c* are formed by the lines in which these large number of depressed portions 3*c* are arranged. On the other hand, a plurality of depressed portions 7 of desired depth are formed by radiation of a laser beam in a portion over a length of Lc' on the way of the whole length of the respective insulating substrates 2*c*, in the vicinity of each scribe line 4*c*, and at desired pitch intervals in the direction parallel with the scribe line 4*c*. the direction parallel with the scribe line 4*c* when a raw substrate 1*b* is broken into insulating substrates or when the insulating substrates are handled, for example, carried, attached and so on.

Not to say, the depressed portions 7 are also formed simultaneously with and in the same process as the formation of the depressed portions 3*c* constituting the scribe line 4*c*.

Thus, a plurality of depressed portions 7 of desired depth are formed by radiation of a laser beam in a portion over a length of Lc' on the way of the whole length Lc of each of the insulating substrates 2*c*, and in the vicinity of the scribe line 4*c* at desired pitch intervals in the direction parallel with the scribe line 4*c*. Accordingly, the strength in the portion where the plural depressed portions 7 are formed at desired pitch intervals in the direction parallel with the scribe line 4*c* is made lower than the strength in the other portion in the longitudinal direction of the insulating substrate 2*c*, that is, in the portion where a plurality of depressed portions 7 are not formed in the direction parallel with the scribe line 4*c*. Accordingly, when the temperature of a heating resistance film 5*c* formed on the insulating substrate 2*c* reaches an abnormal value, the insulating substrate 2*c* can crack surely in the portion where the plural depressed portions 7 are formed in the direction parallel with the scribe line 4*c*. In addition, since this reduction of the strength is much smaller than that in the conventional case where a through hole is formed in the insulating substrate, there is no case where the insulating substrate 2*c* is snapped easily in the portion where the plural depressed portions 7 are formed in

What is claimed is:

1. A structure for use for manufacturing a line-type heater, comprising:

a heating resistance film in an image forming device, the film being formed on a surface of a substrate, a large number of depressed portions formed by radiation of a laser beam in the surface of the substrate corresponding to boundary lines by which the substrate is divided into a plurality of insulating substrates defining strips integrated with each other in parallel, so that said depressed portions are arranged in lines at fixed pitch intervals along said boundary lines, and said lines are formed as scribe lines for breaking said substrate into said insulating substrates;

wherein each of said scribe lines has an area where pitch intervals of said depressed portions are reduced, said area being located apart from a distal end portion of said line-type heater.

2. The structure for use for manufacturing a line-type heater according to claim 1, wherein said area has a portion where the depth of said depressed portions is increased.

3. A structure for use for manufacturing a line-type heater, comprising:

a heating resistance film in an image forming device, the film being formed on a surface of a substrate, a large number of depressed portions formed by radiation of a laser beam in the surface of the substrate corresponding to boundary lines by which the substrate is divided into a plurality of insulating substrates defining strips integrated with each other in parallel, so that said depressed portions are arranged in lines at fixed pitch intervals along said boundary lines, and said lines are formed as scribe lines for breaking said substrate into said insulating substrates;

wherein said substrate comprises additional depressed portions formed by using the same laser beam in each of the insulating substrates, and at least one depressed portion selected from the depressed portions and the additional depressed portions partially penetrates the substrate in a direction through the substrate thickness.

4. The structure for use for manufacturing a line-type heater according to claim 3, wherein the additional depressed portions are arranged in perpendicular to the scribe lines.

5. The structure for use for manufacturing a line-type heater according to claim 3, wherein the additional depressed portions are arranged in parallel to the scribe lines.

6. A structure for use for manufacturing a line-type heater, comprising:

a heating resistance film formed on a surface of a substrate, a large number of depressed portions formed by radiation of a laser beam in the surface of the substrate corresponding to boundary lines by which the substrate is divided into a plurality of insulating substrates defining strips integrated with each other in parallel, so that said depressed portions are arranged in lines at fixed pitch intervals along said boundary lines, and said lines are formed as scribe lines for breaking said substrate into said insulating substrates;

wherein each of said scribe lines has a specific area where pitch intervals of said depressed portions are reduced, said area being located apart from a distal end portion of said line-type heater, said substrate being designed to break at said specific area due to stress caused by heat from said heating resistance film.

7. The structure for use for manufacturing a line-type heater according to claim 6, wherein said area has a portion where the depth of said depressed portions is increased.

8. A structure for use for manufacturing a line-type heater, comprising:

a heating resistance film formed on a surface of a substrate, a large number of depressed portions formed by radiation of a laser beam in the surface of the substrate corresponding to boundary lines by which the substrate is divided into a plurality of insulating substrates defining strips integrated with each other in parallel, so that said depressed portions are arranged in lines at fixed pitch intervals along said boundary lines, and said lines are formed as scribe lines for breaking said substrate into said insulating substrates;

wherein said substrate comprises additional depressed portions in a specific area, said substrate being designed to break at said specific area due to stress caused by heat from said heating resistance film, said additional depressed portions formed by using the same laser beam in each of the insulating substrates, and at least one depressed portion selected from the depressed portions and the additional depressed portions partially penetrates the substrate in a direction through the substrate thickness.

9. The structure for use for manufacturing a line-type heater according to claim 8, wherein the additional depressed portions are arranged in perpendicular to the scribe lines.

10. The structure for use for manufacturing a line-type heater according to claim 8, wherein the additional depressed portions are arranged in parallel to the scribe lines.

11. A structure for use for manufacturing a line-type heater, comprising:

a heating resistance film formed on a surface of a substrate, a large number of depressed portions formed by radiation of a laser beam in the surface of the substrate corresponding to boundary lines by which the substrate is divided into a plurality of insulating substrates defining strips integrated with each other in parallel, so that said depressed portions are arranged in lines at fixed pitch intervals along said boundary lines, and said lines are formed as scribe lines for breaking said substrate into said insulating substrates;

wherein each of said scribe lines has an area where pitch intervals of said depressed portions are reduced, said area being located apart from a distal end portion of said line-type heater, said pitch intervals have a larger pitch for at least three successive adjacent depressed portions and said area where pitch intervals of depressed portions are reduced have at least three successive depressed portions successive and adjacent to said pitch intervals having the larger pitch.

12. The structure for use for manufacturing a line-type heater according to claim 11, wherein said area has a portion where the depth of said depressed portions is increased.

* * * * *